US005248998A

United States Patent [19]

Ochiai et al.

[11] Patent Number: 5,248,998

[45] Date of Patent: Sep. 28, 1993

[54] INK JET PRINT HEAD

[75] Inventors: Kuniaki Ochiai; Shigeo Kimakine, both of Shizuoka, Japan

[73] Assignee: Tokyo Electric Co., Ltd., Tokyo, Japan

[21] Appl. No.: 853,268

[22] Filed: Mar. 18, 1992

[30] Foreign Application Priority Data

Mar. 19, 1991 [JP] Japan ..... 3-054297
Oct. 2, 1991 [JP] Japan ..... 3-255564

[51] Int. Cl.[5] ..... B41J 2/045
[52] U.S. Cl. ..... 346/140 R; 310/333
[58] Field of Search ..... 346/140 R; 310/328, 310/333, 357

[56] References Cited

U.S. PATENT DOCUMENTS 4,525,728 6/1985 Koto ..... 346/140 R
4,752,788 6/1988 Yasuhara et al. ..... 346/140 R
4,879,568 11/1989 Bartky et al. ..... 346/140 R
4,887,100 12/1989 Michaelis et al. ..... 346/140 R

FOREIGN PATENT DOCUMENTS 0095911 12/1983 European Pat. Off. .
0364136 4/1990 European Pat. Off. .

*Primary Examiner*—Mark J. Reinhart
*Assistant Examiner*—Alrick Bobb
*Attorney, Agent, or Firm*—Oblon, Spivak, McClelland, Maier & Neustadt

[57] ABSTRACT

A piezoelectric plate polarized in the direction of its thickness and a base plate having a rigidity lower than that of the piezoelectric plate are joined together. A plurality of parallel grooves are cut through the piezoelectric plate into the base plate so that the grooves are separated from each other by side walls each having an upper portion formed of the piezoelectric plate and a lower portion formed of the base plate. A top plate is attached to the upper surface of the piezoelectric plate to close the upper open ends of the grooves. A nozzle plate provided with a plurality of ink jets is attached to one end of the assembly of the base plate, the piezoelectric plate and the top plate so that the ink jets correspond respectively to the grooves to form pressure chambers. Electrodes are formed by depositing a metal over bottom surface of the grooves and side surfaces of the side walls. In straining the side walls by applying a voltage across the electrodes to jet the ink through the ink jet, the resistance of the lower side walls against the deformation of the upper side walls is relatively small, so that the upper side walls can readily be greatly strained. The piezoelectric plate is formed to an optimum thickness as a function of the reciprocal of the rigidity of the base plate, the elastic constant of the material forming the piezoelectric plate and the height of the side walls.

3 Claims, 11 Drawing Sheets

INK JET PRINT HEAD

FIELD OF THE INVENTION AND RELATED ART STATEMENT

The present invention relates to an on-demand ink jet print head.

FIG. 14 shows an ink jet print head of an invention disclosed in Japanese Patent Laid-open (Kokai) No. Hei 2-150355. Referring to FIG. 14, a bottom sheet 30 having a polarity indicated by the arrows is provided with a plurality of parallel grooves 31 defined by side walls 32 and a bottom wall 33. A top sheet 35 is attached adhesively by an adhesive layer 36 to the upper ends 34 of the side walls 32 to close the open upper end of the grooves 31. Upper portions of the side surfaces of the side walls 32, namely, the side surfaces of each groove 31, of a length corresponding to substantially half the depth of the groove 31 are metallized by evaporation to form electrodes 37.

The bottom sheet 30 is held on a jig in a vacuum evaporation apparatus and parallel atomic beams of a metal are projected on one side surface of each side wall 32 of the bottom sheet 30 at an angle δ to the same side surface of each side wall 32, as shown in FIG. 15 to deposit a metal film, i.e., the electrodes 37, on the side surface of each side wall 32. Then, the bottom sheet 30 is turned through an angle of 180° in a horizontal plane, as viewed in FIG. 15, and the bottom sheet 30 is subjected to the same vacuum evaporation process to deposit a metal film, i.e., the electrodes 37, on the other side surface of each side wall 32. Thus, the electrodes 37 are formed by evaporation on the respective upper halves of the opposite side surfaces of each side wall 32. Metal films deposited on the upper ends 34 of the side walls 32 are removed in the next process.

The grooves 31 are closed by the top sheet 35 to form pressure chambers. Then, an ink inlet opening to be connected to an ink supply unit is formed in one end of each pressure chamber, and an ink jet through which ink is jetted is formed in the other end of the pressure chamber to complete an ink jet print head.

When voltages of opposite polarities are applied to the electrodes 37 of the two adjacent side walls 32, shearing strains as indicated by dotted lines in FIG. 14 result from a potential of a direction perpendicular to the direction of polarity of the bottom sheet 30 indicated by the arrows acting on the side walls 32. Consequently, the volume of the pressure chamber (the groove 31) between the sheared side walls 32 is reduced instantaneously, and thereby the internal pressure of the pressure chamber is increased sharply to jet the ink through the ink jet.

FIGS. 16(*a*) and 16(*b*) shows an ink jet print head of an invention disclosed in Japanese Patent Laid-open (Kokai) No. Sho 63-247051. Referring to FIG. 16(*a*), a bottom wall 38, a hard side wall 39, a top wall 40 and an actuator 41 are combined so as to form a passage 42. The actuator 41 is formed of a piezoelectric ceramic and is polarized in a direction along a Z-axis. A strip seal 43 is attached to the upper end of the actuator 41 so as to be held between the actuator 41 and the top wall 40. The lower end of the actuator 41 is joined to the bottom wall 38. Electrodes 44 and 45 are formed on the opposite side surfaces of the actuator 41. A nozzle 46 is provided at the front end of the passage 42. When ink is supplied from an ink supply unit into the passage 42 and an electric field is applied to the electrodes 44 and 45, the actuator 41 is strained as shown in FIG. 16(*b*) to compress the passage 42 and, consequently, the ink is jetted through the nozzle 46.

The ink jet print head disclosed in Japanese Patent Laid-open (Kokai) No. Hei 2-150355 has the following disadvantages. The side walls 32 cannot sufficiently be strained (deformed). The side wall 32 is strained by an electric field of a direction perpendicular to the direction of polarization of the bottom sheet 30 created by applying a voltage across the opposite electrodes 37 formed on the opposite side surfaces of the groove 31. Then, the strain of the upper half portions of the side wall 32 provided with the electrodes 37 is sustained by the lower half portion of the same not provided with any electrode 37. Accordingly, the lower half portion of the side wall 32 acts as a resistance against the straining of the upper half portion of the same side wall 32. Since the side wall 32 is a solid body formed of single material (piezoelectric material) and having a high rigidity, it is impossible to strain the side wall 32 greatly and hence the variation in the volume of the pressure chamber is relatively small.

The ink jet print head requires a costly process for forming the electrodes 37. Since the electrodes 37 must be formed only in the upper half portions of the side surfaces of the side walls 32, a special vacuum evaporation apparatus having a complicated construction must be used for forming the electrodes 37. Furthermore, the process of forming the electrodes 37 must be carried out in a plurality of steps of projecting the parallel atomic beams of a metal on one side surface of each side wall 32 at the predetermined angle δ to the side surface to form the electrode 37 on one side surface of each side wall 32, turning the bottom sheet 30 through an angle of 180° in a horizontal plane, and projecting the parallel atomic beams of a metal again on the other side surface of each side wall 32 at the predetermined angle δ to the side surface to form the electrode 37 on the other side surface of each side wall 32.

In the ink jet print head disclosed in Japanese Patent Laid-open (Kokai) No. Sho 63-247051, the rigidity of the strip seal 43 affects greatly to the strain of the actuator 41 formed of the piezoelectric ceramic. However, nothing is mentioned about the material and rigidity of the strip seal 43. Even if it is supposed, on the basis of the construction of known ink jet print heads, that the strip seal 43 has a relatively low rigidity, the relation between the strip seal 43 and the depth of the passage 42, and the straining characteristic of the actuator 41 is not known at all.

OBJECT AND SUMMARY OF THE INVENTION

Accordingly, it is an object of the present invention to provide an ink jet print head having pressure chambers capable of greatly varying in volume and having an improved ink jetting characteristic.

In one aspect of the present invention, an ink jet print head comprises: a piezoelectric plate formed of a piezoelectric material, polarized in the direction of its thickness and provided with a plurality of parallel slots separated from each other by upper side walls; a base plate formed of a nonconductive, nonelectrostrictive material, having a relatively low rigidity, provided with a plurality of parallel grooves separated from each other by lower side walls and joined to the piezoelectric plate so that the grooves are aligned respectively with the slots of the piezoelectric plate and the lower side walls ar connected respectively to the upper side walls to form side walls to form pressure chambers; a plurality of electrodes formed over the entire bottom surfaces and the side surfaces of the side walls; a top plate joined to the upper surface of the piezoelectric plate so as to seal the pressure chambers; and a nozzle plate provided with a plurality of ink jets and joined to one end of the assembly of the piezoelectric plate, the base plate and the top plate so that the ink jets correspond respectively to the pressure chambers, wherein the thickness y of the piezoelectric plate is nearly equal to a value calculated by using:

$$y = \frac{S_p h - \sqrt{(S_p h)^2 - (S_p - S_{44}) S_p h^2}}{S_p - S_{44}}$$

where $S_p$ is the reciprocal of the rigidity of the base plate, $S_{44}$ is the elastic constant of the piezoelectric plate and h is the depth of the pressure chambers. The side walls are deformed by applying a voltage to the electrodes to decrease the volume of the pressure chamber so that the internal pressure of the pressure chamber is increased to jet the ink through the ink jet. Since the upper portion of the side wall, i.e., the upper side wall, is formed of the piezoelectric material having a relatively high rigidity and the lower portion of the side wall, i.e., the lower side wall, is formed of the nonconductive, nonelectrostrictive material having a relatively low rigidity, the resistance of the lower side wall against the straining of the upper side wall can be reduced. The side wall can be strained greatly when the thickness y of the piezoelectric plate, the reciprocal $S_p$ of the rigidity of the base plate, the elastic constant $S_{44}$ of the piezoelectric plate and the depth h of the pressure chamber are determined so as to meet the foregoing expression to provide the ink jet print head with an improved ink jetting characteristic.

Since the lower side walls of the opposite side walls of the pressure chamber are formed of a nonelectrostrictive material having a relatively low rigidity, an electric field can be applied only to the upper side wall formed of the piezoelectric material even if the electrode is formed over the bottom surface and side surfaces of the pressure chamber and hence the ink jet print head of the present invention eliminates a complicated process of forming on only a portion of each side wall.

DETAILED DESCRIPTION OF THE PREFERRED EMBODIMENTS

An ink jet print head in a first embodiment according to the present invention will be described hereinafter with reference to FIGS. 1 to 9. First, referring to FIG. 3(*a*), a piezoelectric plate 2 formed of a piezoelectric material and polarized in the direction of its thickness is joined adhesively with an adhesive to the upper surface of a base plate 1 formed of a nonconductive, nonelectrostrictive material having a rigidity lower than that of the piezoelectric material forming the piezoelectric plate 2. The nonconductive, nonelectrostrictive material forming the base plate 1 employed in this embodiment is a liquid crystal polymer (ZAITER ®, Nippon Sekiyu Kagaku K.K.). The adhesive is a nonconductive industrial adhesive. Bubbles contained in the adhesive reduce the adhesive strength of the adhesive and hence, if necessary, the adhesive is deaerated. The desirable thickness of the film of the adhesive is on the order of 1 μm. The characteristics of the piezoelectric plate 2 is deteriorated if the same is heated above a predetermined temperature because the piezoelectric plate 2 is polarized. Therefore, in adhesively joining together the base plate 1 and the piezoelectric plate 2, an adhesive which is capable of hardening at a hardening temperature that will not deteriorate the characteristics of the piezoelectric plate 2 should be used. The adhesive employed in this embodiment is SCOTCH WELD 1838B/A ® (Sumitomo 3M K.K.).

Figure 3A:
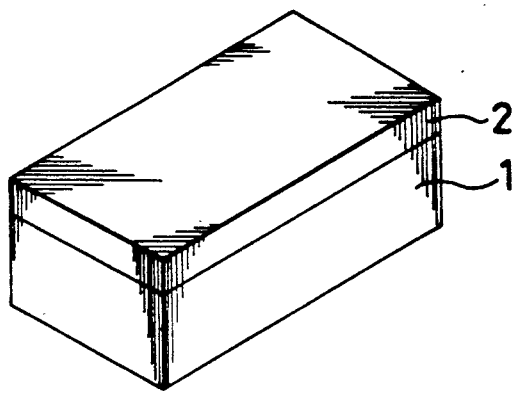
FIGS. 3(*a*), 3(*b*) and 3(*c*) are perspective views of assistance in explaining steps of fabricating the ink jet print head of FIG. 1.
Figure 3B:
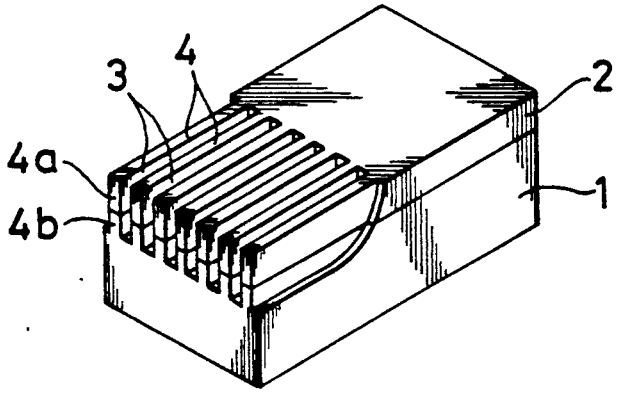
Figure 3C:
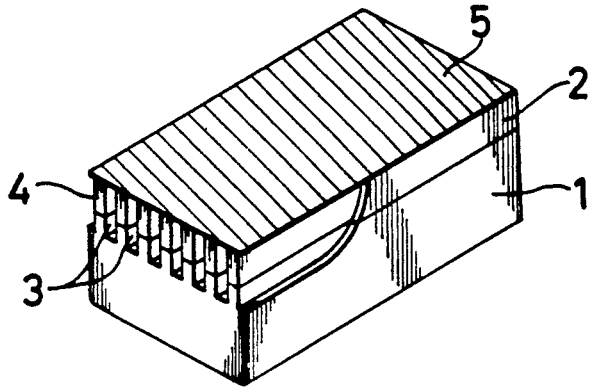

Referring to FIG. 3(*b*), a plurality of parallel grooves 3 are cut at predetermined intervals through the piezoelectric plate 2 into the base plate 1 by grinding. Before cutting the grooves 3 by grinding, the bottom surface of the base plate 1 is ground with reference to the surface of the piezoelectric plate 2 to finish the work consisting of the base plate 1 and the piezoelectric plate 2 in a predetermined thickness, the base plate 1 is fixed to the bed of a grinding machine, and the feed of the grinding machine is determined with reference to the surface of the bed to form the grooves 3 in a predetermined depth.

Naturally, the depth of the grooves 3 may be determined with reference to the surface of the piezoelectric plate 2 to omit the process of grinding the bottom surface of the base plate 1. The grooves 3 are separated from each other by side walls 4. Each side wall 4 consists of an upper side wall 4a formed of the piezoelectric material of the piezoelectric plate 2, and a lower side wall 4b having a rigidity lower than that of the upper side wall 4a. The grooves 3 are 80 μm in width and 160 μm in depth, and the pitch of the grooves 3 is 169 μm. Generally, a diamond wheel employed in a dicing saw for dicing wafers to provide IC chips is used for forming the grooves 3. In this embodiment, a 2 in. diameter diamond wheel NBCZ1080® or NBCZ1090® (K.K. Disuko) is used. The diamond wheel is rotated at 30,000 rpm in forming the grooves 3. Since the base plate 1 is formed of the liquid crystal polymer, the grooves 3 can be formed without forming any burrs.

The work consisting of the base plate 1 and the piezoelectric plate 2 is subjected to pretreatment before forming electrodes by electroless plating. The surfaces of the work are etched for thirty minutes by a 30% potassium hydroxide solution heated at 50° C. to finish the surfaces of the grooves 3 in a roughness capable of securing a sufficiently high adhesion of the plated film to the surfaces of the grooves 3. Then, the work is subjected to a cleaning and conditioning process using a cationic surface active agent for degreasing and for improving the catalyst adsorbing property of the surfaces of the grooves 3. Then, the work is subjected to a pretreatment process for applying a catalyst to the surfaces of the work. In this pretreatment process, the work is washed with water, the work is immersed in a catalyst solution containing a neutral salt, such as NaCl, Pd and Sn, the work is treated by an acid accelerator, so that only Pd as a catalyst remains over the surfaces of the work, and then the work is dried to complete the pretreatment. It is desirable to employ an ultrasonic device to make the solution permeate the surfaces of the groove 3 perfectly.

Figure 4A:
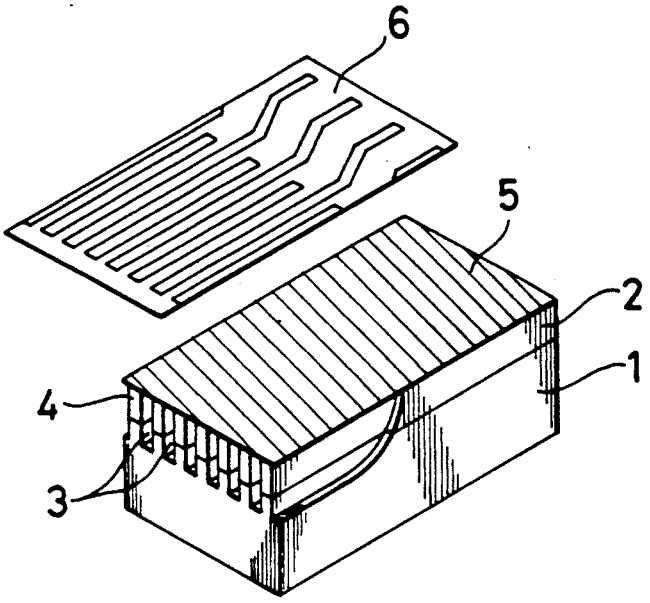
FIGS. 4(*a*) and 4(*b*) are perspective views of assistance in explaining steps of fabricating the ink jet print head of FIG. 1.
Figure 4B:
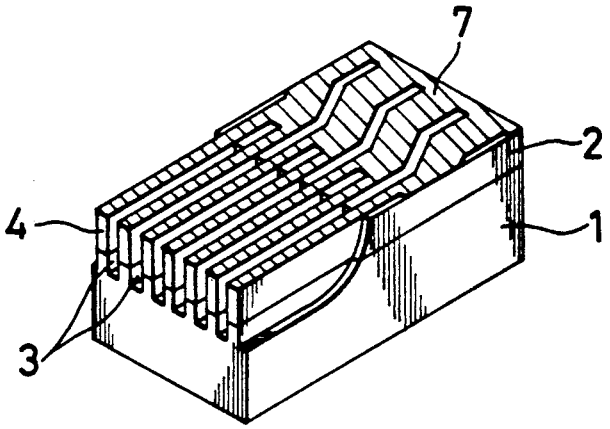

Then, a resist film 7 is formed over the surface of the piezoelectric plate 2. The resist film 7 covers portions of the surface of the piezoelectric plate 2 other than those in which electrodes and a wiring pattern of a conductive film are to be formed. A dry film 5 is formed over the surface of the piezoelectric plate 2 as shown in FIG. 3(*c*), a mask 6 is placed on the dry film 5 as shown in FIG. 4(*a*) and the dry film 5 is exposed to light and the exposed dry film 5 is subjected to developing to form the resist film 7 over the surface of the piezoelectric plate 2 excluding portions in which electrodes and a wiring pattern of a conductive film are to be formed. The surfaces of the portions in which electrodes and a wiring pattern of a conductive film are to be formed are coated with Pd, i.e., a catalyst.

Figure 5A:
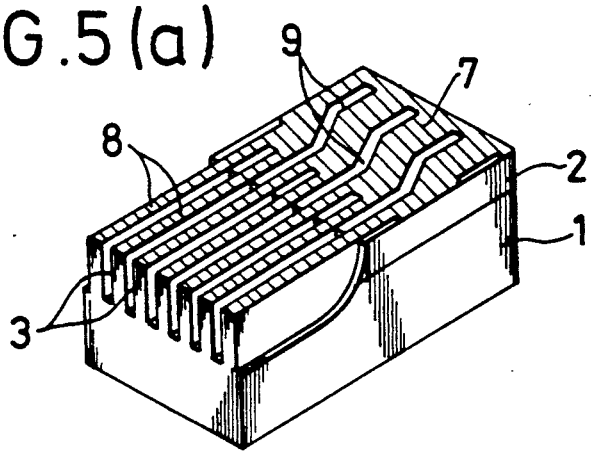
FIGS. 5(*a*), 5(*b*) and 5(*c*) are perspective views of assistance in explaining steps of fabricating the ink jet print head of FIG. 1.
Figure 5B:
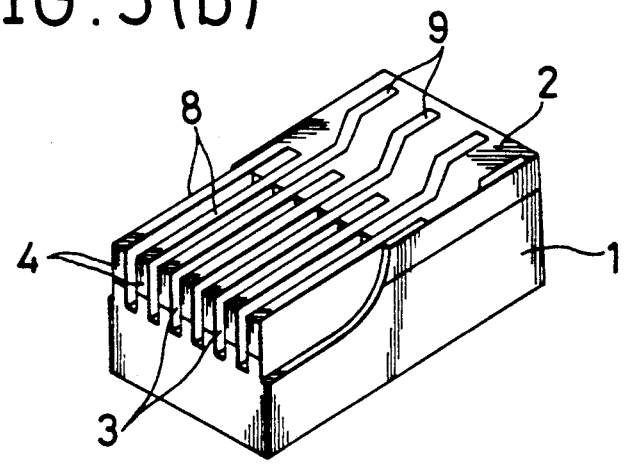
Figure 5C:
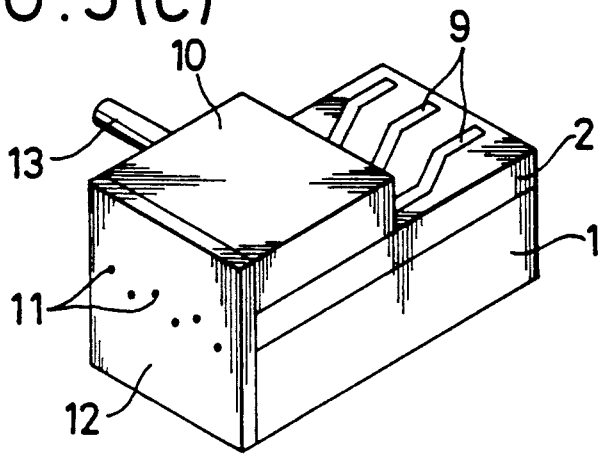

Then, the work is immersed in a plating bath for electroless plating. The portions of the surface of the work other than those in which electrodes and a wiring pattern are to be formed are protected from the plating bath by the resist film 7. Suitable metals to be deposited by electroless plating are gold and nickel. The plating bath contains a metallic salt and a reducing agent as principal components, and additives, such as a pH regulator, a buffer, a complexing agent, an accelerator, a stabilizer, a modifier and the like. In this embodiment, a low-temperature Ni-P plating bath is used. A layer of metal is formed by electroless plating in a thickness in the range of 2 to 3 μm. Since electroless plating, differing from electroplating, is a chemical process, the mode of deposition of the metal can simply be controlled by regulating the pH and the concentration of the components of the plating bath. When the work is immersed in the plating bath, Pd (catalyst) spread over the surface of the portions not coated with the resist film 7 acts as a catalyst and the metal is deposited in those portions of the surface of the work. After Pd has been coated with a film of the deposited metal, the autocatalysis of the deposited metal promotes electroless plating. When the metal is deposited in a film of a desired thickness, the electroless plating process is terminated. Thus, electrodes 8 are formed over the entire side surfaces of the side walls 4 defining the grooves 3 and not coated with the resist film 7, and a wiring pattern 9 continuous with the electrodes 8 is formed in the portions of the surface of the piezoelectric plate 2 not coated with the resist film 7 as shown in FIG. 5(*a*). Since the plating bath permeates the minute structure of the surface of the base plate 1 and the piezoelectric plate 2 and few pinholes are formed in the films of the deposited metal, the side surfaces of the side walls 4 and the film of the adhesive, which is not sufficiently resistant to water, formed between the base plate 1 and the piezoelectric plate 2 defining the grooves 3 are protected from the ink. Accordingly, any additional protective film is unnecessary. The electrodes 8 and the wiring pattern 9 are formed in a uniform thickness.

Then, as shown in FIG. 5(*b*), the resist film 7 is removed from the surface of the piezoelectric plate 2.

Figure 1:
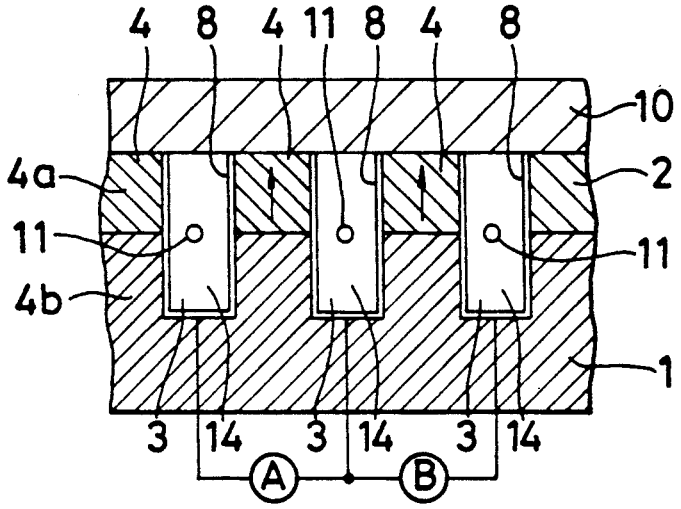
FIG. 1 is a longitudinal sectional front view according to the present invention.

Then, as shown in FIG. 5(*c*), a top plate 10 is attached adhesively to the upper surface of the piezoelectric plate 2. Since the resist film 7 of about 20 μm in thickness, which is thicker than the metal film formed by electroless plating, has been removed, the top plate 10 can satisfactorily be attached to the upper surface of the piezoelectric plate 2. A nozzle plate 12 provided with a plurality of ink jets 11 is attached to one end of the assembly of the base plate 1, the piezoelectric plate 2 and the top plate 10 so that the ink jets 11 correspond respectively to the grooves 3 to complete the ink jet print head. An ink supply pipe 13 is joined to the top plate 10 to connect the grooves 3 to an ink supply unit, not shown. As shown in FIG. 1, the respective upper ends of the grooves 3 are closed by the top plate 10 to form pressure chambers 14.

Operation of the ink jet print head thus constructed in jetting the ink from the middle pressure chamber 14, as viewed in FIG. 1, will be described hereinafter. The pressure chambers 14 are filled up with the ink supplied through the ink supply pipe 13 from the ink supply unit. A voltage A is applied through the wiring pattern 9 across the electrode 8 of the middle pressure chamber 14 and the electrode 8 of the left pressure chamber 14 on the left-hand side of the middle pressure chamber 14, and a voltage B of a polarity reverse to that of the voltage A is applied through the wiring pattern 9 across the electrode 8 of the middle pressure chamber 14 and the electrode 8 of the right pressure chamber 14 on the right-hand side of the middle pressure chamber 14 to apply an electric field of a direction perpendicular to the direction of polarization indicated by the arrows to the upper side walls 4a. Consequently, the side wall 4 on the left-hand side of the middle pressure chamber 14 is strained to the left and the side wall 4 on the right-hand side of the middle pressure chamber 14 is strained to the right to increase the volume of the middle pressure chamber 14 and to reduce the respective volumes of the pressure chambers 14 on the opposite sides of the middle pressure chamber 14.

Figure 2:
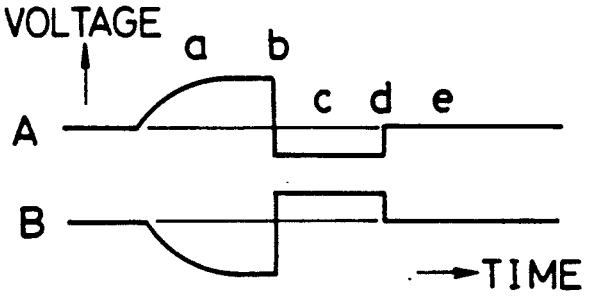
FIG. 2 is a timing diagram of assistance in explaining a manner of applying a voltage to the electrode of the ink jet print head of FIG. 1.

Since the voltages A and B are increased gradually in a fixed time period a as shown in FIG. 2, the ink is not jetted through the ink jets 11 of the right and left pressure chambers 14, though the respective volumes of the right and left pressure chambers 14 are reduced. The level of the ink in the middle pressure chamber 14 is lowered slightly when the volume of the middle pressure chamber 14 is increased and the internal pressure of the middle pressure chamber 14 is decreased, and then the ink is sucked through the ink supply pipe 13 into the middle pressure chamber 14. The polarities of the voltages A and B are reversed instantaneously at time b (FIG. 2) to strain instantaneously the side wall 4 on the left-hand side of the middle pressure chamber 14 to the right and the side wall 4 on the right-hand side of the middle pressure chamber 14 to the left. Consequently, the volume of the middle pressure chamber 14 is reduced sharply to jet the ink through the ink jet 11 of the middle pressure chamber 14. The voltages A and B of the reverse polarities are maintained for a predetermined time period c (FIG. 2). While the ink is thus jetted through the ink jet 11, the droplet of the ink jetted through the ink jet 11 is continuous with the ink jet 11. At time d, the voltages A and B are removed instantaneously from the electrodes 8 to allow the strained side walls 4 to restore to their original shapes rapidly Consequently, the internal pressure of the middle pressure chamber 14 drops sharply and thereby a rear portion of the ink droplet flying in the vicinity of the ink jet 11 is separated from the ink droplet on the axis of the ink et 11 and is sucked into the middle pressure chamber 14. Thus, the ink droplet flies in a fixed direction and is not separated into a plurality of smaller ink droplets which form satellite dots. Although the internal pressures of the right and left pressure chambers 14 increase at the moment when the voltages A and B are removed from the electrodes 8, the internal pressures do not increase to a pressure level high enough to jet the ink through the ink jets 11.

Thus, the upper side walls 4*a* of the side walls 4 are portions of the piezoelectric plate 2 formed of a piezoelectric material having a high rigidity and the lower side walls 4*b* of the side walls 4 are portions of the base plate 1 formed of a material having a rigidity lower than that of the piezoelectric material forming the piezoelectric plate 2. Therefore, the upper side walls 4*a* can be strained greatly without being obstructed significantly by the lower side walls 4*b* to enhance the ink jetting characteristic of the ink jet print head.

Figure 6:
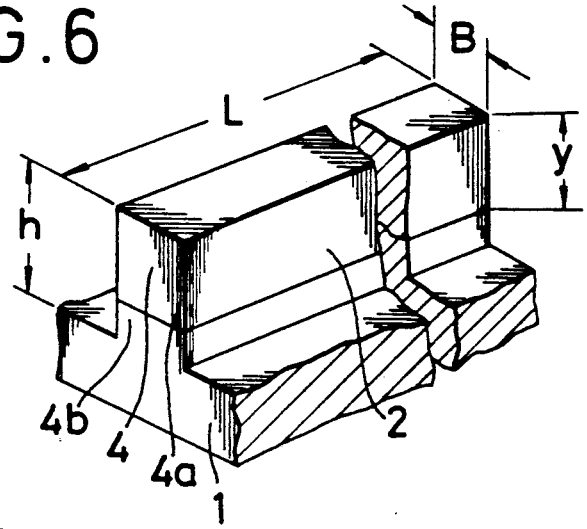
FIG. 6 is a fragmentary perspective view of assistance in explaining the dimensions of side walls of the ink jet print head of FIG. 1.

Incidentally, suppose that each side wall 4 has a height h (depth of the groove 3) of 160 μm, a width B of 80 μm and a length L of 10 mm as shown in FIG. 6 and $$d_{15}=564\times10^{-12}\ m/V$$

$$S_{44}=37.4\times10^{-12}\ m^2/N$$

where $d_{15}$ is the piezoelectric constant of the piezoelectric plate 2 and $S_{44}$ is the elastic constant of the piezoelectric plate 2.

Figure 7:
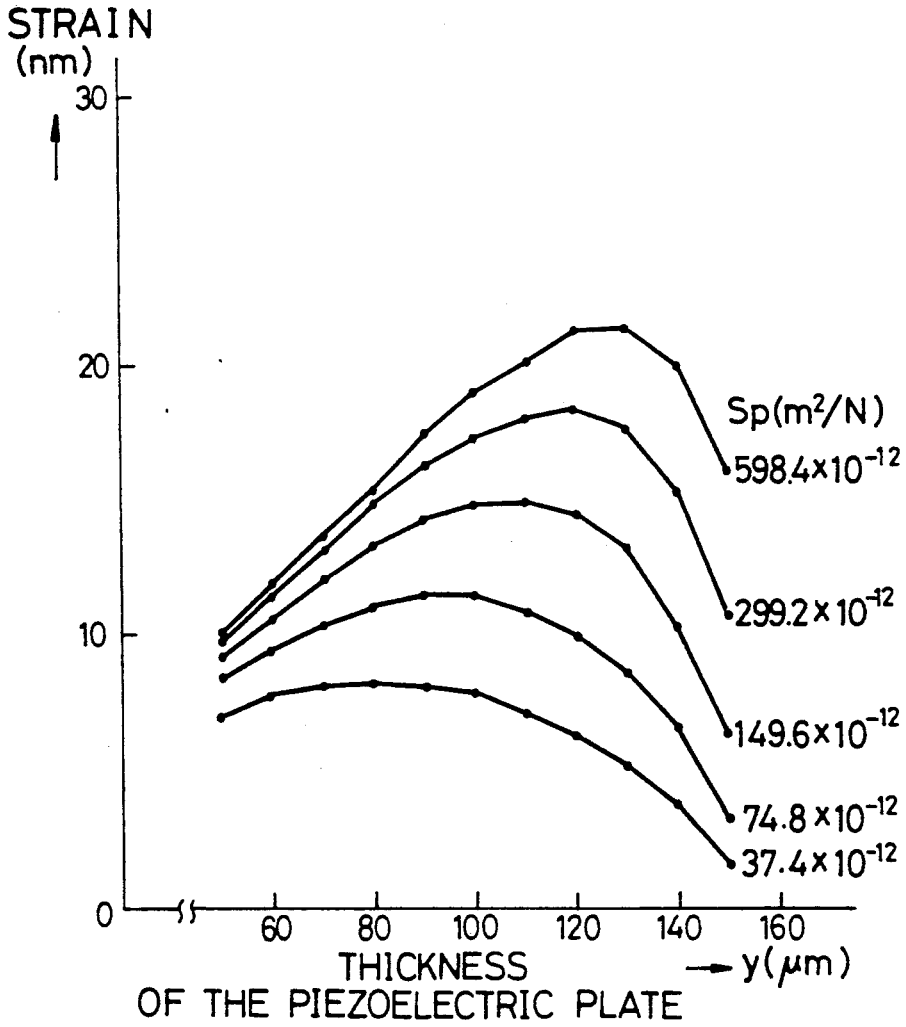
FIG. 7 is a graph showing the variation of strain in a piezoelectric plate with the thickness of the piezoelectric plate for the elastic constant of the piezoelectric plate.
Figure 8:
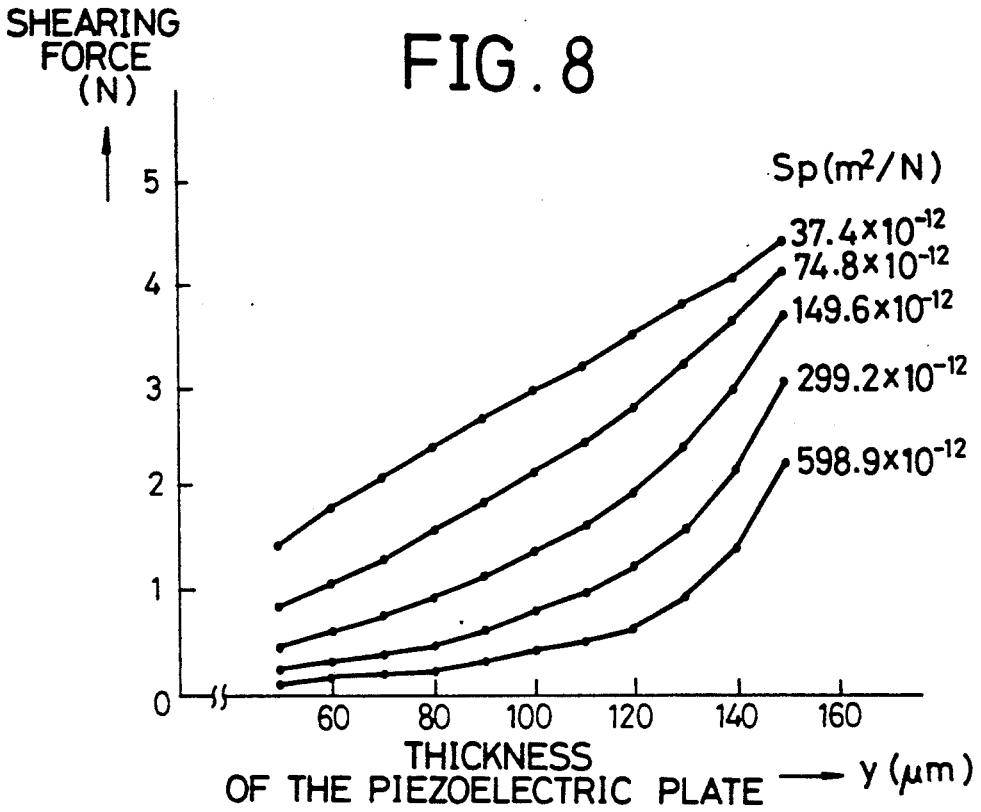
FIG. 8 is a graph showing the variation of shearing force with the thickness of the piezoelectric plate for the elastic constant of the piezoelectric plate.
Figure 9:
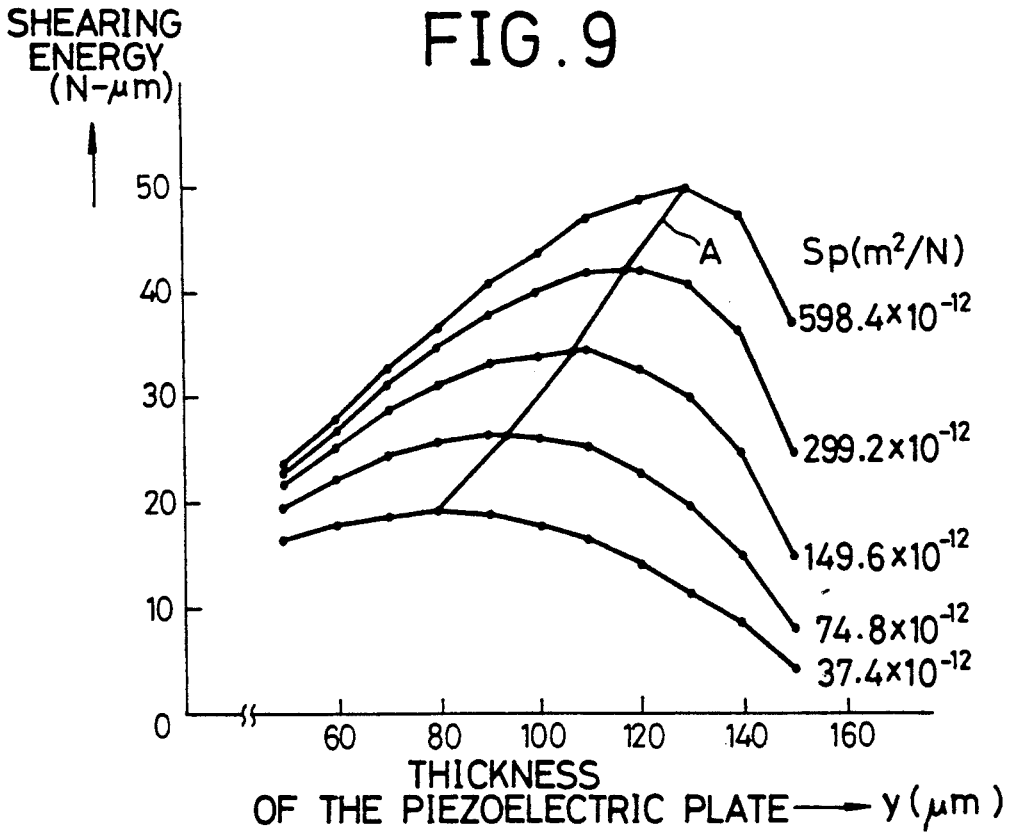
FIG. 9 is a graph showing the variation of shearing energy with the thickness of the piezoelectric plate for the elastic constant of the piezoelectric plate.

The variation of the strain of the side wall 4 (FIG. 7), the variation of shearing force acting on the side wall (FIG. 8) and the variation of strain energy stored in the side wall 4 with the thickness y of the piezoelectric plate 2 (FIG. 9) for the elastic constant (the reciprocal of rigidity) of the base plate 1 will be examined. In FIGS. 7, 8 and 9, curves for $S_p=37.5\times10^{-12}\ m^2/N$ represent the characteristics of the side wall of the conventional ink jet print head, in which the side wall is formed entirely of the material forming the piezoelectric plate. As is obvious from FIG. 7, the strain of the side wall 4 is larger, namely, the efficiency of straining the side wall 4 is higher, for the larger elastic constant $S_p$ of the base plate 1. Thus, the elastic constant $S_p$ of the base plate 1, the height h of the side wall 4 (the depth of the groove 3) and the thickness y of the piezoelectric plate 2 are determined selectively to obtain an ink jet print head having optimum strain, shearing and energy characteristics.

Referring to FIG. 9, every energy-thickness curve for elastic constant $S_p$ of the base plate 1 has a maximum. In FIG. 9, a curve indicated at A passes the maxima of the curves. The thickness y of the piezoelectric plate 2 corresponding to the maximum is expressed as a function of the height h of the side wall 4 (the depth of the groove 3), the elastic constant $S_{44}$ of the piezoelectric plate 2 and the elastic constant $S_p$ (the reciprocal of the rigidity) of the base plate 1.

$$Y=\frac{S_p h-\sqrt{(S_p h)^2-(S_p-S_{44})S_p h^2}}{S_p-S_{44}}$$

The piezoelectric plate 2 is designed in a thickness approximately equal to the thickness y calculated by using this expression to obtain an ink jet print head provided with side walls 4 capable of being deformed greatly, and having an enhanced ink jet characteristic.

Possible materials for forming the base plate 1 are not limited to the foregoing material; the base plate 1 may be formed of any suitable material, provided that the material is nonconductive and nonelectrostrictive, the rigidity of the material is lower than that of the material forming the piezoelectric plate 2, the base plate 1 formed of the material can be attached adhesively to the piezoelectric plate 2, the surfaces of the grooves 3 of the base plate 1 formed of the material can be finished by grinding with a diamond wheel in smooth surfaces, and the metal for forming the electrodes 8 can be deposited in a high adhesion by electroless plating over the surfaces of the grooves 3 when the base plate 1 and the piezoelectric plate 2 are subjected simultaneously to electroless plating. The electrodes 8 may be formed of inexpensive Ni. However, if the Ni electrodes 8 are subject to the corrosive action of the ink, the electrodes 8 may be formed of gold. To suppress an increase in cost of the ink jet print head, the electrodes 8 may be formed by depositing a Ni film and coating the Ni film with a thin film of gold.

Figure 10A:
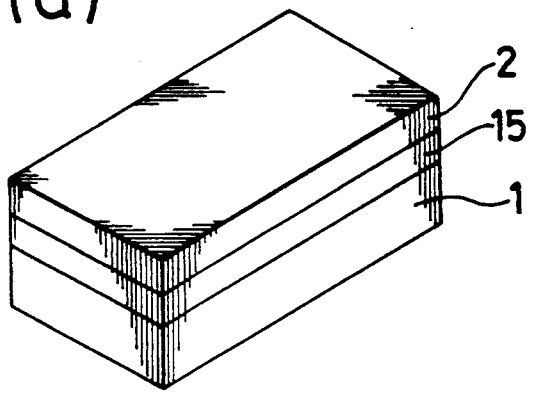
FIGS. 10(*a*), 10(*b*) and 10(*c*) are perspective views of assistance in explaining steps of fabricating an ink jet print head in a second embodiment according to the present invention.
Figure 10B:
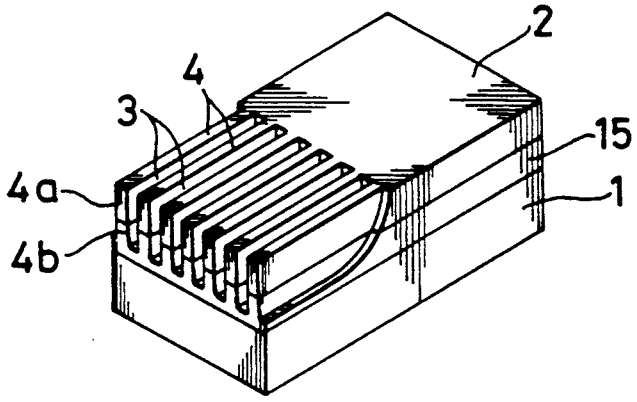
Figure 10C:
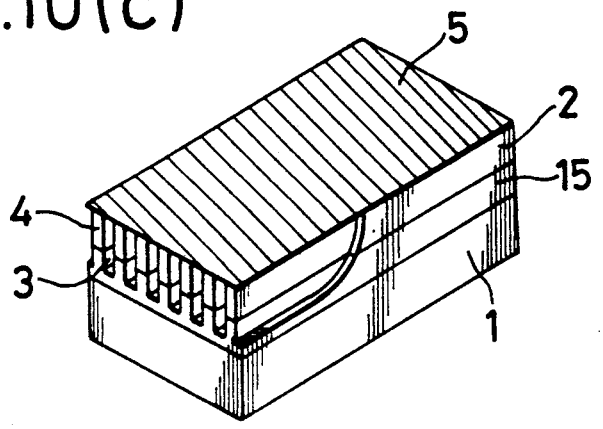

An ink jet print head in a second embodiment according to the present invention, will be described hereinafter with reference to FIGS. 10(*a*) to 13, in which parts like or corresponding to those of the ink jet print head in the first embodiment are denoted by the same reference characters and the description thereof will be omitted to avoid duplication. Referring to FIG. 10(*a*), an adhesive containing an epoxy resin or the like having a high adhesive strength is spread over the surface of a base plate 1 in an adhesive layer 15, a piezoelectric plate 2 polarized in the direction of its thickness is put on the base plate 1, and then the adhesive layer 15 is hardened to bond together the base plate 1 and the piezoelectric plate 2. Thus, a three-layer structure consisting of the base plate 1, the adhesive layer 15 and the piezoelectric plate 2 is constructed. The adhesive layer 15 is nonconductive and nonelectrostrictive, and has a relatively low rigidity. Accordingly, the base plate 1 may be formed of aluminum unsusceptible to thermal deformation or a material having a relatively high rigidity, such as glass. Since the piezoelectric plate 2 is polarized, the adhesive layer 15 is formed of an adhesive capable of hardening at a hardening temperature at which the piezoelectric plate 2 may not be deteriorated by heat. In this embodiment, the adhesive is SCOTCH WELD 1838B/A ® (Sumitomo 3M K.K.).

Then, as shown in FIG. 10(*b*), a plurality of parallel grooves 3 are cut at predetermined intervals through the piezoelectric plate 2 into the adhesive layer 15 by grinding. Before cutting the grooves 3 by grinding, the bottom surface of the base plate 1 is ground with reference to the surface of the piezoelectric plate 2 to finish the work consisting of the base plate 1, the piezoelectric plate 2 and the adhesive layer 15 in a predetermined thickness, the base plate 1 is fixed to the bed of a grinding machine, and the feed of the grinding machine is determined with reference to the surface of the bed to form the grooves 3 in a predetermined depth. Naturally, the depth of the grooves 3 may be determined with reference to the surface of the piezoelectric plate 2 to omit the process of grinding the bottom surface of the base plate 1. The grooves 3 are separated from each other by side walls 4. Each side wall 4 consists of an upper side wall 4*a* formed of portions of the piezoelectric plate 2 having a relatively high rigidity and a lower side wall 4*b* having a rigidity lower than that of the upper side wall 4*a*.

Figure 11A:
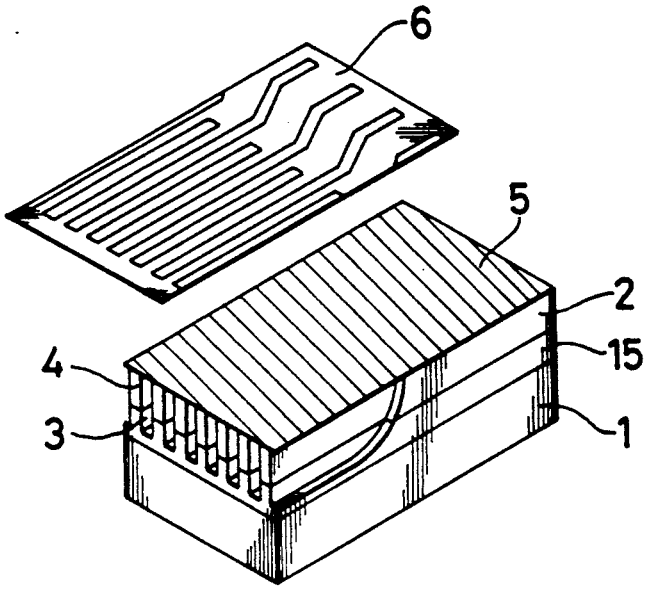
FIGS. 11(*a*) and 11(*b*) are perspective views of assistance in explaining steps of fabricating the ink jet print head in the second embodiment.
Figure 11B:
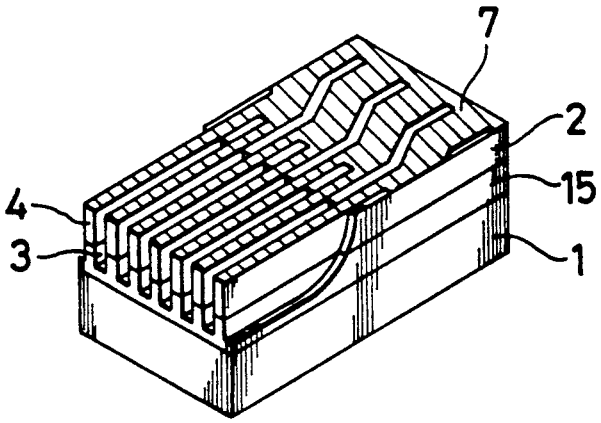

Before subjecting the work to electroless plating, the work, similarly to the work in the first embodiment, is subjected to pretreatment including washing with water, immersion in a catalyst solution, treatment with an accelerator and etching. A dry film 5 is formed over the surface of the piezoelectric plate 2 as shown in FIG. 10(*c*), a mask 6 is placed on the dry film 5 as shown in FIG. 11(*a*), the work is exposed to light through the mask 6, and then the dry film 5 is developed to form a resist film 7 as shown in FIG. 11(*b*) over portions of the surface of the piezoelectric plate 2 other than those in which electrodes and a wiring pattern is to be formed. A catalyst, such as Pd, remains in the portions in which electrodes and a wiring pattern are to be formed.

Figure 12A:
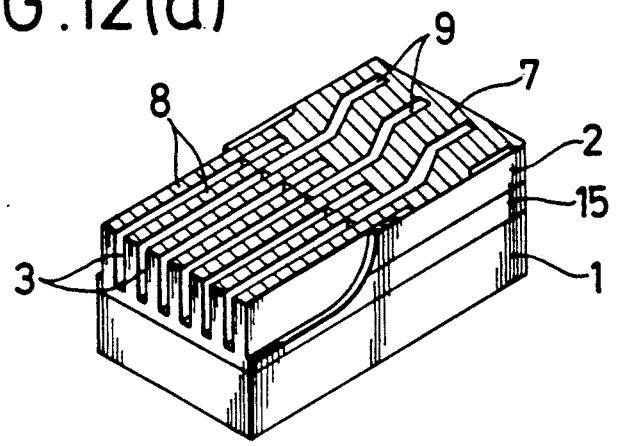
FIGS. 12(*a*), 12(*b*) and 12(*c*) are perspective views of assistance in explaining steps of fabricating the ink jet print head in the second embodiment.
Figure 12B:
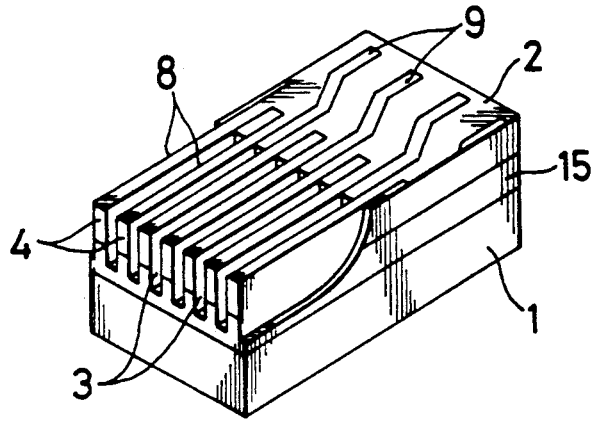
Figure 12C:
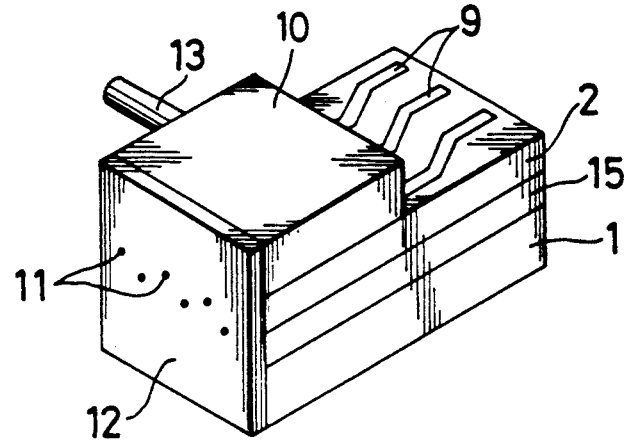
Figure 13:
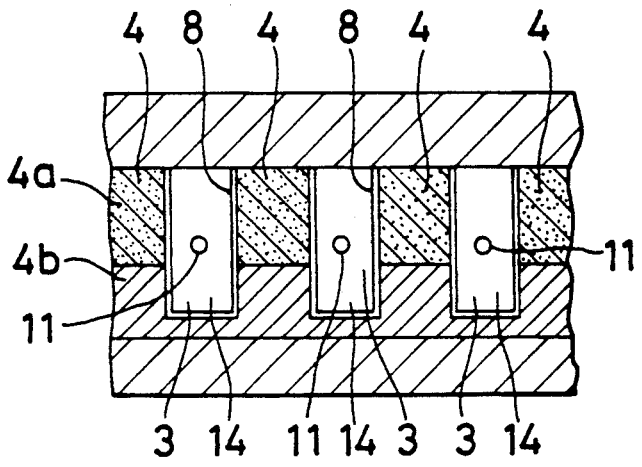
FIG. 13 is a longitudinal sectional front view of the ink jet print head in the second embodiment.
Figure 14:
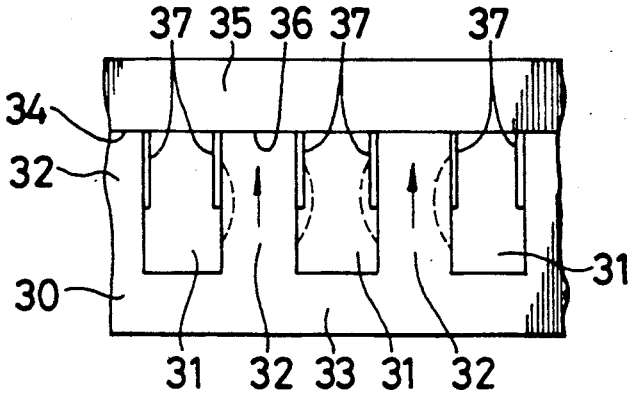
FIG. 14 PRIOR ART
FIG. 14 is a longitudinal sectional side view of a conventional ink jet print head.
Figure 15:
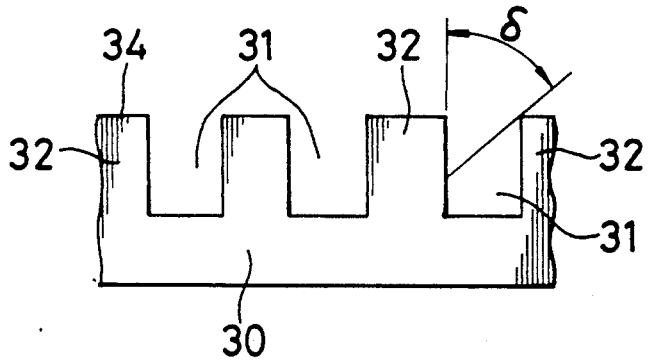
FIG. 15 PRIOR ART
FIG. 15 is a side view of assistance in explaining electrodes for the ink jet print head of FIG. 14.
Figure 16A:
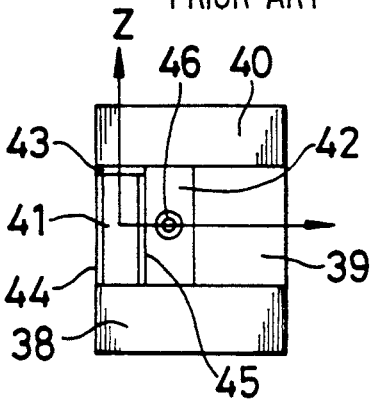
FIG. 16(a) PRIOR ART
FIGS. 16(*a*) and 16(*b*) are longitudinal sectional side views of another conventional ink jet print head.
Figure 16B:
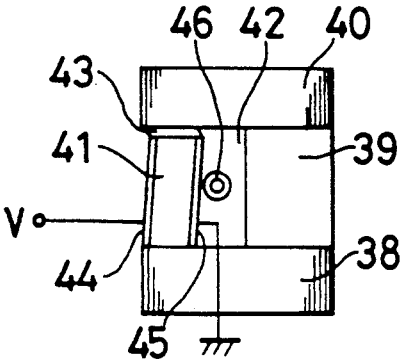
FIG. 16(b) PRIOR ART

Then, the work is immersed in a plating bath for electroless plating. Portions of the surface of the piezoelectric plate 2 other than those in which electrodes and a wiring pattern are to be formed are protected from the resist film 7. Upon the deposition of the metal in a film of a desired thickness, the electroless plating process is terminated. Thus, electrodes 8 are formed over the entire surfaces of the grooves 3, and a wiring pattern 9 connected with the electrodes 8 is formed over portions of the surface of the piezoelectric plate 2 not coated with the resist film 7 as shown in FIG. 12(*a*). Then, the resist film 7 is removed (FIG. 12(*b*)). Then, a top plate 10 is attached adhesively to the upper surface of the piezoelectric plate 2 to form pressure chambers 14 (FIG. 13), and a nozzle plate 12 provided with ink jets 11 is fixed to one end of the assembly of the base plate 1, the piezoelectric plate 2, the adhesive layer 15 and the top plate 10 as shown in FIG. 12(*c*) so that the ink jets 11 correspond respectively to the pressure chambers 14 to complete an ink jet print head.

Thus, the upper side walls 4*a* of the side walls 4 are portions of the piezoelectric plate 2 having a relatively high rigidity, and the lower side walls 4*b* of the side walls 4 are portions of the adhesive layer 15 having a rigidity lower than that of the piezoelectric plate 2. Therefore, the upper side walls 4*a* can be strained greatly without being obstructed significantly by the lower side walls 4*b* to enhance the ink jetting characteristic of the ink jet print head.

Since the adhesive layer 15 bonding together the base plate 1 and the piezoelectric plate 2 has a relatively low rigidity, the base plate 1 may be formed of a material having a relatively high rigidity, so that the grooves 3 can readily and correctly be formed in a desired depth, which makes it possible to strain the side walls 4 evenly and to jet the ink evenly through the ink jets 11.

The ink jet print head in accordance with the present invention comprises: the piezoelectric plate polarized in the direction of its thickness and provided with the plurality of parallel slots separated from each other by the upper side walls; the nonconductive, nonelectrostrictive member having a relatively low rigidity, provided with the plurality of parallel grooves separated from each other by the lower side walls and joined to the piezoelectric plate so that the grooves correspond respectively to the slots and the lower side walls are connected respectively to the upper side walls so as to form the side walls; the plurality of electrodes formed by depositing a metal over the bottom surfaces of the grooves and the side surfaces of the side walls; the top plate attached to the upper surface of the piezoelectric plate to form the pressure chambers; and the nozzle plate provided with the ink jets and joined to one end of the assembly of the nonconductive, nonelectrostrictive member, the piezoelectric plate and the top plate so that the ink jets correspond respectively to the pressure chambers, wherein the thickness y of the piezoelectric plate is nearly equal to a value calculated by using an expression:

$$y = \frac{S_p h - \sqrt{(S_p h)^2 - (S_p - S_{44}) S_p h^2}}{Sp - S_{44}}$$

where $S_p$ is the reciprocal of the rigidity of the nonconductive, nonelectrostrictive member, $S_{44}$ is the elastic constant of the piezoelectric plate and h is the height of the side walls. The side walls are deformed by applying a voltage across the electrodes so that the volume of the pressure chamber is reduced and the internal pressure of the pressure chamber is increased to jet the ink through the ink jet. Since the upper side wall of the side wall is a portion of the piezoelectric plate having a relatively high rigidity and the lower side wall of the side wall is a portion of the nonconductive, nonelectrostrictive member having a relatively low rigidity, the resistance of the lower side wall against the straining of the upper side wall is relatively small. The thickness y of the piezoelectric plate, the reciprocal $S_p$ of the rigidity of the nonconductive, nonelectrostrictive member, the elastic constant $S_{44}$ of the piezoelectric plate and the height h of the side walls are determined in optimum values so that the side walls can be strained greatly, and thereby the ink jetting characteristic of the ink jet print head can be enhanced. When the base plate and the piezoelectric plate are bonded together by the adhesive layer having a relatively low rigidity, the base plate may be formed of a material having a relatively high rigidity, which enables the grooves to be formed readily and correctly in a desired depth. Thus, the side walls can be strained evenly, the ink can evenly jetted through the ink jets and a complicated process of forming electrodes only in limited portions of the side walls can be omitted.

What is claimed is:

1. An ink jet print head comprising:

a piezoelectric plate polarized in a direction of said plate thickness;

a nonconductive, nonelectrostrictive member having a rigidity lower than that of the piezoelectric plate and attached to a lower surface of the piezoelectric plate;

a top plate attached to an upper surface of the piezoelectric plate; and a nozzle plate provided with a plurality of ink jets and attached to one end of an assembly of the piezoelectric plate, the nonconductive, nonelectrostrictive member and the top plate;

wherein a plurality of parallel grooves are cut through the piezoelectric plate into the nonconductive, nonelectrostrictive member so as to form grooves separated from each other by side walls each consisting of an upper side wall being a portion of the piezoelectric plate and a lower side wall being a portion of the nonconductive, nonelectrostrictive member, electrodes are formed by depositing a metal over bottom surfaces of the grooves and side surfaces of the side walls, the grooves are closed by the top plate and the nozzle plate so as to form pressure chambers, and the thickness of the piezoelectric plate is approximately a value y expressed by:

$$y = \frac{S_p h - \sqrt{(S_p h)^2 - (S_p - S_{44}) S_p h^2}}{S_p - S_{44}}$$

where $S_p$ is the reciprocal of the rigidity of the nonconductive, nonelectrostrictive member, $S_{44}$ is the elastic constant of the material forming the piezoelectric plate and h is the height of the side walls.

2. An ink jet print head according to claim 1, wherein the nonconductive, nonelectrostrictive member is a plate formed of a plastic.

3. An ink jet print head according to claim 1, wherein the nonconductive, nonelectrostrictive member is an adhesive layer formed between the piezoelectric plate and a base plate.

* * * * *

UNITED STATES PATENT AND TRADEMARK OFFICE

CERTIFICATE OF CORRECTION

PATENT NO. : 5,248,998

DATED : September 28, 1993

INVENTOR(S) : Kuniaki Ochiai et al.

It is certified that error appears in the above-indentified patent and that said Letters Patent is hereby corrected as shown below:

On the title page, Item [75],

The second inventor's name, should read: --Shigeo Komakine--

Signed and Sealed this

Twenty-second Day of March, 1994

*Attest:*

Bruce Lehman

BRUCE LEHMAN

*Attesting Officer*

*Commissioner of Patents and Trademarks*